US010469941B2

(12) United States Patent
Dave et al.

(10) Patent No.: US 10,469,941 B2
(45) Date of Patent: Nov. 5, 2019

(54) VENTED ACOUSTIC TRANSDUCERS AND RELATED METHODS AND SYSTEMS

(71) Applicant: Apple Inc., Cupertino, CA (US)

(72) Inventors: Ruchir M. Dave, San Jose, CA (US); Jesse A. Lippert, San Jose, CA (US); Nikolas T. Vitt, Sunnyvale, CA (US); Scott P. Porter, San Jose, CA (US); Eugene Fox, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/676,210

(22) Filed: Aug. 14, 2017

(65) Prior Publication Data

US 2018/0063634 A1 Mar. 1, 2018

Related U.S. Application Data

(60) Provisional application No. 62/462,758, filed on Feb. 23, 2017, provisional application No. 62/378,589, filed on Aug. 23, 2016.

(51) Int. Cl.
*H04R 1/28* (2006.01)
*H04R 1/02* (2006.01)
(Continued)

(52) U.S. Cl.
CPC ..... *H04R 1/2849* (2013.01); *H04R 1/023* (2013.01); *H04R 1/025* (2013.01); *H04R 1/44* (2013.01);
(Continued)

(58) Field of Classification Search
CPC .... H04R 1/2846; H04R 1/2849; H04R 1/023; H04R 1/025; H04R 1/44; H04R 1/38;
(Continued)

(56) References Cited

U.S. PATENT DOCUMENTS 5,701,358 A * 12/1997 Larsen ..... H04R 9/063 381/400
5,812,496 A * 9/1998 Peck ..... H04R 1/44 367/168

(Continued)

FOREIGN PATENT DOCUMENTS

CN 1922919 2/2007
CN 204598311 8/2015

(Continued)

OTHER PUBLICATIONS

Office Action in Chinese Utility Model Application No. 201820074006.7, dated Jun. 28, 2019, 20 pages.

*Primary Examiner* — Harry S Hong
*Assistant Examiner* — Sabrina Diaz
(74) *Attorney, Agent, or Firm* — Ganz Pollard, LLC

(57) ABSTRACT

An acoustic transducer can have an acoustic diaphragm defining a barometric vent configured to equalize a barometric pressure-gradient across the acoustic diaphragm. Such a barometric vent can be formed by an aperture through the acoustic diaphragm. A gas-permeable vent membrane can be coupled with the acoustic diaphragm and extend across the aperture. The vent membrane can inhibit movement of liquid across the vent membrane. An acoustic-transducer module can include a chassis a chassis configured to mount the acoustic-transducer module to another module, and a suspension system can movably couple the acoustic diaphragm with the chassis. Such an acoustic-transducer module can sealably couple with a housing of a water-resistant electronic device to inhibit a flow of liquid into the housing while providing a water-resistant barometric vent to the housing, as well as an acoustic diaphragm having a sufficient size to meet or exceed selected acoustic-performance targets.

31 Claims, 13 Drawing Sheets

(51) Int. Cl.

| | |
|---|---|
| ***H04R 1/44*** | (2006.01) |
| ***H04R 7/10*** | (2006.01) |
| *H04R 1/08* | (2006.01) |
| *H04R 9/06* | (2006.01) |
| *H04R 9/08* | (2006.01) |
| *H04R 31/00* | (2006.01) |

(52) U.S. Cl.
CPC ..... *H04R 7/10* (2013.01); *H04R 1/086* (2013.01); *H04R 9/06* (2013.01); *H04R 9/08* (2013.01); *H04R 31/003* (2013.01); *H04R 2307/025* (2013.01)

(58) Field of Classification Search
CPC ..... H04R 2207/00; H04R 7/00; H04R 7/02; H04R 7/06
USPC ..... 381/150, 347, 332, 348, 355, 184, 398, 381/423, 424, 426, 429
See application file for complete search history.

(56) References Cited

U.S. PATENT DOCUMENTS

| | | | | |
|---|---|---|---|---|
| 7,702,124 | B2 * | 4/2010 | Niederdraenk | H04R 1/086 381/322 |
| 2014/0233767 | A1 | 8/2014 | Chen et al. | |
| 2015/0110320 | A1 * | 4/2015 | Liu | H04R 1/1016 381/322 |
| 2015/0163572 | A1 * | 6/2015 | Weiss | H04R 1/02 381/337 |
| 2016/0205469 | A1 * | 7/2016 | Steijner | H04R 1/44 381/334 |
| 2017/0325011 | A1 * | 11/2017 | Kuki | B32B 27/30 |
| 2018/0035203 | A1 * | 2/2018 | Hirai | H04R 1/44 |

FOREIGN PATENT DOCUMENTS

| | | |
|---|---|---|
| CN | 205647943 | 10/2016 |
| CN | 106385644 | 2/2017 |
| CN | 205961413 | 2/2017 |

* cited by examiner

VENTED ACOUSTIC TRANSDUCERS AND RELATED METHODS AND SYSTEMS

BACKGROUND

This application, and the innovations and related subject matter disclosed herein, (collectively referred to as the "disclosure") generally concern vented acoustic transducers and related methods and systems. Some configurations of disclosed acoustic transducers combine or integrate attributes and structure conventionally found distributed between or among separate system components or modules. Such configurations can eliminate one or more conventional components while retaining one or more functions conventionally provided by the eliminated component. More particularly but not exclusively, acoustic transducers having a vented acoustic diaphragm are disclosed. Examples of acoustic-transducers include loudspeaker transducers, and microphone transducers. Both can have a barometrically-vented diaphragm and are but specific examples of disclosed acoustic transducers used herein to facilitate description of innovative principles that can be applied among a variety of transducer embodiments, as will be appreciated by those of ordinary skill in the art following a careful review of this disclosure. As well, this disclosure describes examples of systems and methods pertaining to innovative acoustic transducers.

In general, an acoustic signal constitutes a vibration that propagates through a carrier medium, such as, for example, a gas, a liquid, or a solid. An acoustic transducer, in turn, is a device configured to convert an incoming acoustic signal to another form of signal (e.g., an electrical signal), or vice-versa. Thus, an acoustic transducer in the form of a loudspeaker can convert an incoming signal (e.g., an electro-magnetic signal) to an emitted acoustic signal, while an acoustic transducer in the form of a microphone can be configured to convert an incoming acoustic signal to another form (e.g., an electro-magnetic signal).

A loudspeaker can emit an acoustic signal in a carrier medium by vibrating or moving an acoustic diaphragm to induce, or otherwise inducing, a pressure variation or other vibration in the carrier medium. For example, an electro-magnetic loudspeaker arranged as a direct radiator can induce a time-varying magnetic flux in a coil (e.g., a wire formed of copper clad aluminum wrapped around, for example, a bobbin) by passing a corresponding time-varying current through the coil (sometimes referred to in the art as a "voice coil"). The coil can be positioned adjacent one or more magnets (e.g., a permanent magnet having a fixed, or an electromagnet having a variable, magnetic field). A resultant force as between the magnetic flux emanated from the coil and the magnetic field(s) of the one or more magnets can urge the coil into motion, preferably a pistonic motion in some embodiments.

The coil, in turn, can be directly or indirectly coupled with an acoustic diaphragm configured to induce a pressure variation in a surrounding carrier medium as the diaphragm moves in correspondence with the, e.g., pistonic, movement of the coil. The diaphragm can be rigid, or semi-rigid, and often is light weight to reduce inertial effects and allow the acoustic diaphragm to vibrate or otherwise induce a pressure variation or other vibration in a surrounding or adjacent carrier medium. The coil and/or the bobbin can provide a measure of structural stability to the membrane, as to maintain predominately pistonic movement in the diaphragm.

Further, the diaphragm can be suspended from or otherwise movably supported by a frame. A suitable suspension system generally provides a restoring force to the diaphragm to maintain the coil in a desired position and/or orientation. The suspension allows for controlled axial (e.g., pistonic) motion, while largely preventing lateral motion or tilting that could cause the coil to strike another motor component, or otherwise induce distortion or mechanical inefficiency leading to degraded performance of the transducer.

Conversely, despite having a similar physical arrangement compared to the just-described loudspeaker, a microphone transducer can be configured to convert an incoming acoustic signal to, for example, an electrical signal. For example, an acoustic diaphragm of a microphone transducer can vibrate, move, or otherwise respond to a pressure variation received through a surrounding or adjacent carrier medium. Movement of the coil through the magnetic field can induce a corresponding electrical current through the coil. Accordingly, a time-varying movement of the coil can induce a corresponding time-varying electrical current through the coil. Such a time-varying electrical current can be converted to a machine-readable form (e.g., digitized).

Regardless of their precise configuration, performance or operation of such acoustic transducers can be negatively affected, and such transducers can even be rendered inoperable, if the mode of emitting or receiving an acoustic signal is inhibited or prevented. For example, some use conditions can apply a load to a conventional acoustic diaphragm sufficient to inhibit or prevent movement or vibration of the diaphragm. More specifically, a large pressure gradient applied across a conventional acoustic diaphragm can bias the diaphragm to an outermost (or innermost) position of displacement. As another example, a contaminant can prevent or inhibit movement of an acoustic diaphragm past a given position within the diaphragm's typical range-of-displacement. In either event, operation of the acoustic transducer, whether configured as a loudspeaker or a microphone, can be negatively affected, or the transducer can be altogether rendered inoperable. Examples of negative effects include acoustic distortion or lower-than-normal amplitude (e.g., emitted or detected loudness). Such performance degradation can continue until the pressure gradient is equalized, or the contaminant is removed.

Barometrically venting an acoustic enclosure or module has been proposed to alleviate or to eliminate such pressure-induced performance degradation. As but one example, U.S. Pat. No. 9,363,587, which is hereby incorporated by reference as fully as if reproduced herein in its entirety, for all purposes, disclosed a pressure vent for speaker or microphone modules.

Moreover, acoustic transducers, as well as modules and systems incorporating such transducers, continue to be made smaller. However, it may be desirable in some instances for an acoustic transducer, and more particularly for an acoustic diaphragm, to maintain a physical size above a lower threshold size to achieve desired acoustic properties and/or functional attributes.

Thus, a need remains for acoustic transducers suitable for use across a wide range of environmental (or ambient) pressures. As well, a need remains for acoustic transducers configured to meet or to exceed desired acoustic performance targets. And, a need exists for such acoustic transducers to be configured for use in a compact physical environment.

SUMMARY

The innovations disclosed herein overcome many problems in the prior art and address one or more aforementioned or other needs. In some respects, the innovations disclosed herein generally concern vented acoustic transducers, and more particularly, but not exclusively acoustic transducers having a vented acoustic diaphragm. Related methods and systems also are disclosed.

A disclosed acoustic transducer incorporates a barometrically vented acoustic diaphragm. Such an acoustic transducer can equalize barometric pressure across the acoustic diaphragm, while retaining sufficient surface area and/or sufficient volume for the acoustic diaphragm to meet or exceed aggressive acoustic targets (e.g., desired sound pressure levels across various selected frequency bands).

Notably, disclosed acoustic transducers stand in stark contrast to acoustic transducers incorporated in previously proposed acoustic modules. Those previously proposed acoustic modules incorporated an acoustic transducer separate from a barometric vent. As a consequence, such previously proposed acoustic modules can have difficulty meeting acoustic targets in area- or volume-constrained applications because the corresponding acoustic diaphragm has limited size to allow for a separate, e.g., spaced-apart, or adjacent, barometric vent.

By contrast, disclosed acoustic transducers eliminate the need for a separate barometric vent, while retaining the pressure-equalization function and capability of prior barometric vents. Consequently, disclosed acoustic transducers and modules incorporating them can provide a larger acoustic diaphragm relative to previous vented acoustic-modules, while still being barometrically vented. Vented acoustic diaphragms, as described herein, can allow disclosed acoustic transducers and modules incorporating them to meet or exceed acoustic targets in area- or volume-constrained applications, while retaining barometric-pressure-equalization capabilities previously only attainable by way of acoustic modules having a separate acoustic transducer and barometric-vent in a relatively larger volume.

Disclosed acoustic transducers have an acoustic diaphragm. The acoustic diaphragm has opposed first and second major surfaces and defines a barometric vent configured to equalize a barometric pressure gradient between the first and second major surfaces. Such a vent can include a gas-permeable region. In some instances, the gas-permeable region also is liquid-impermeable below a selected pressure gradient across the vent.

In some instances, an aperture defined by the acoustic diaphragm forms the barometric vent. A gas-permeable vent membrane can be coupled with the acoustic diaphragm and can extend across the aperture. Such a vent membrane can inhibit movement of liquid across the membrane. For example, the vent membrane can prevent movement of water across (or through) the vent membrane for hydrostatic pressure gradients (e.g., a hydrostatic driving force) across the vent membrane below a selected threshold hydrostatic pressure gradient. A representative example of a vent membrane can be formed of PTFE or ePTFE, though other suitable materials can be used in place of or in addition to PTFE or ePTFE. Such materials include, for example, polymerized fibers (e.g., polyvinylidene fluoride, or polyvinylidene difluoride, both of which generally are referred to in the art as "PVDF" and are inert thermoplastic fluoropolymers produced by the polymerization of vinylidene difluoride).

In general, a suitable vent membrane for a particular application can permit a flow of gas therethrough while being impermeable to a liquid at liquid breakthrough pressures below a selected threshold pressure.

As used herein, the term "PTFE" means polytetrafluoroethylene. PTFE, commonly referred to by the DuPont trademark Teflon® or the ICI trademark Fluon®, is well known for its chemical resistance, thermal stability, and hydrophobicity. Expanded PTFE, sometimes also referred to as ePTFE, has a porous structure defined by a web of interconnected fibrils. ePTFE commonly has a porosity of about 85% by volume, but because of its hydrophobicity, has a relatively high liquid breakthrough pressure (i.e., a threshold hydrostatic pressure below which the ePTFE remains impermeable to the liquid) for a variety of liquids, including water.

Some disclosed acoustic transducers have a liquid-impermeable encapsulant (or, more generally, laminate) extending at least partially across one or both of the first and the second major surfaces of the acoustic diaphragm. Such an encapsulant or laminate can enhance liquid-impermeability of the acoustic diaphragm with little or no degradation in acoustic performance. An example of such an encapsulant or laminate includes overmolded silicone applied to the respective one or both of the first and the second major surfaces of the acoustic diaphragm. The encapsulant or laminate can define one or more apertures positioned in correspondence to the gas-permeable vent membrane, or vent region.

In some embodiments, a segment of an outer periphery of the vent membrane and a corresponding portion of the acoustic diaphragm form a laminated construction. For example, an outer periphery of the vent membrane can be adhered or otherwise sealably affixed to the first major surface or to the second major surface in a region adjacent the aperture in the acoustic diaphragm.

Moreover, some acoustic diaphragm embodiments have a laminated construction, where a first layer defines the first major surface and a second layer defines the second major surface. With such an arrangement, the segment of the outer periphery of the vent membrane can be positioned between the first layer and the second layer of the acoustic diaphragm.

Some disclosed acoustic transducers have more than one aperture extending through the acoustic diaphragm. Accordingly, the aperture described above can constitute a first aperture, and the acoustic diaphragm can define at least a second aperture spaced apart from the first aperture. Nonetheless, the vent membrane can have a unitary construction spanning across the first aperture and the second aperture. In other embodiments, the vent membrane is segmented such that separate vent membranes are applied across each respective aperture, or group of apertures.

Some disclosed acoustic diaphragms can include one or more features arranged to place the vent membrane in tension. For example, a given acoustic diaphragm can have one or more vent-membrane anchors positioned outward of each aperture forming an opening of the barometric vent. The vent membrane can be affixed or otherwise mounted to the vent-membrane anchors, and the vent membrane anchors and/or a portion of the acoustic diaphragm can be configured to urge outwardly of the aperture, tensioning the vent membrane.

A single-layer acoustic diaphragm can provide such tension by having a conical, a concave or a convex, or otherwise recessed or protruding shape that can be partially "flattened" after the vent membrane is affixed or otherwise mounted to the diaphragm. Such flattening can urge an interface region of the acoustic diaphragm outward of the aperture(s) defining the barometric vent, placing the vent membrane in tension.

A laminated acoustic diaphragm can be similarly flattened to place a vent membrane in tension. Additionally, or alternatively, the first layer of the acoustic diaphragm and the second layer of the acoustic diaphragm define complementarily shaped contours configured to matingly engage with the vent membrane. When such a construct is at least partially flattened, the vent membrane can be placed in tension. In some instances, one or the other of the layers is partially flattened when the first layer and the second layer are matingly engaged with each other, placing the vent membrane into tension.

Despite there being a wide variety of types of acoustic transducers, some disclosed electromagnetic transducers have a voice coil coupled with the acoustic diaphragm, such that the diaphragm and the coil are movable in correspondence with each other. A magnet can be so positioned adjacent the voice coil as to cause a magnetic field of the magnet to interact with a magnetic flux corresponding to an electrical current through the voice coil. In some instances, the magnet constitutes an inner magnet, and the transducer can have an outer magnet, with the voice coil being positioned between the inner magnet and the outer magnet. The voice coil can be arranged to move pistonically to and fro between a distal-most position and a proximal-most position relative to the inner magnet.

The inner magnet and the vent membrane and/or the second major face of the acoustic diaphragm can be complementarily configured relative to each other. For example, the inner magnet can be configured to support the vent membrane and/or the second major face of the acoustic diaphragm against a barometric pressure urging the vent membrane and/or the second major face of the acoustic diaphragm into contact with the inner magnet.

Some acoustic transducers can have a circuit board positioned within an outer periphery of the barometric vent. An outer edge of the circuit board can be spaced apart from the outer periphery of the aperture through the acoustic diaphragm to define a gap. The vent membrane can span the gap between the outer edge of the circuit board and the outer periphery of the aperture.

Some acoustic transducers have a diaphragm with an aperture. A flexible circuit board, sometimes referred to as "flex circuit" or "flex" in the art, can span across the aperture. In some instances, the flex can sealingly mate with the diaphragm around a periphery of the aperture. The flex can be perforated or otherwise define one or more through-hole apertures sized to permit a desired flow of gas to pass therethrough. The flex, in turn, can be operatively coupled with one or more components. Such a component can include a sensor of various types, and/or other functional and/or computational attributes. A vent membrane of a type described herein can span across each of the one or more through-hole apertures defined by the flex.

The circuit board can be operatively coupled with (e.g., can have mounted thereto or have integrally formed therewith) a displacement sensor configured to measure a displacement of the circuit board, and thus displacement of a region of the acoustic diaphragm adjacent the circuit board. Additionally, or alternatively, the circuit board can be operatively coupled with a pressure transducer configured to detect a change in barometric pressure above a selected lower-threshold change in barometric pressure.

A combined center-of-mass of the acoustic diaphragm, the vent membrane, and the circuit board can be substantially coincident with an axis-of-movement of the acoustic diaphragm. For example, the acoustic diaphragm can move pistonically along a centrally positioned longitudinal axis, and the combined center-of-mass can be positioned on or sufficiently near the longitudinal axis that the assembly of the acoustic diaphragm, the vent membrane, and the circuit board do not tilt, move in-band, or otherwise deviate from a sufficiently uniform pistonic motion as to cause an unsuitable deterioration in performance of the acoustic transducer (e.g., to induce distortion, lose efficiency, or otherwise prevent the diaphragm from vibrating as intended).

Also disclosed are systems and methods related to disclosed acoustic transducers. For example, a disclosed acoustic module can have a barometrically vented acoustic transducer arranged as indicated herein. The module can also have a chassis configured to mount the acoustic-transducer module to another module or housing. A suspension system can movably couple the acoustic diaphragm of the transducer with the chassis or a frame.

As another example, a water-resistant electronic device can include a housing defining an interior chamber and having an exterior. A passage can extend through the housing from the exterior of the housing to the interior chamber. An acoustic-transducer module can sealably couple with the housing at an interface region corresponding to the passage so as to inhibit a flow of gas or liquid across the interface region. The acoustic-transducer module can have a barometrically vented acoustic diaphragm arranged as described herein. As but one example, a hydrophobic vent membrane can sealingly engage with the acoustic diaphragm and span across an aperture or other opening in the acoustic diaphragm so as to form a water-resistant barometric vent within the acoustic diaphragm. The barometric vent can be configured to permit a pressure-equalization flow of gas across the acoustic diaphragm and to inhibit a flow of liquid, into or out of the interior chamber across the acoustic diaphragm. Accordingly, a barometric pressure within the interior chamber can be equalized with a barometric pressure external to the housing, while preventing or inhibiting intrusion of water or other contaminants to the interior chamber. An electronic component that otherwise would be susceptible to damage if exposed to a liquid (e.g., water) can be positioned in the interior chamber of the housing.

The foregoing and other features and advantages will become more apparent from the following detailed description, which proceeds with reference to the accompanying drawings.

BRIEF DESCRIPTION OF THE DRAWINGS

Unless specified otherwise, the accompanying drawings illustrate aspects of the innovations described herein. Referring to the drawings, wherein like numerals refer to like parts throughout the several views and this specification, several embodiments incorporating presently disclosed principles are illustrated by way of example, and not by way of limitation.

DETAILED DESCRIPTION

The following describes various innovative principles concerning vented acoustic transducers, and related methods and systems, by way of reference to specific embodiments. For example, certain aspects of disclosed subject matter pertain to vented acoustic diaphragms, and more particularly but not exclusively to water-resistant vents in acoustic diaphragms. Embodiments of such vents described in context of specific acoustic transducer configurations (e.g., electrodynamic loudspeakers or microphones), particular module arrangements, and particular system arrangements, are but particular examples of contemplated vented acoustic transducers and related systems chosen as being convenient illustrative examples of disclosed principles. Nonetheless, one or more of the disclosed principles can be incorporated in various other embodiments of acoustic transducers, modules, and systems to achieve any of a variety of corresponding system characteristics.

Thus, vented acoustic transducers, modules, and systems (and associated techniques) having attributes that are different from those specific examples discussed herein can embody one or more presently disclosed innovative principles, and can be used in applications not described herein in detail. Accordingly, such alternative embodiments can also fall within the scope of this disclosure.

Figure 1:
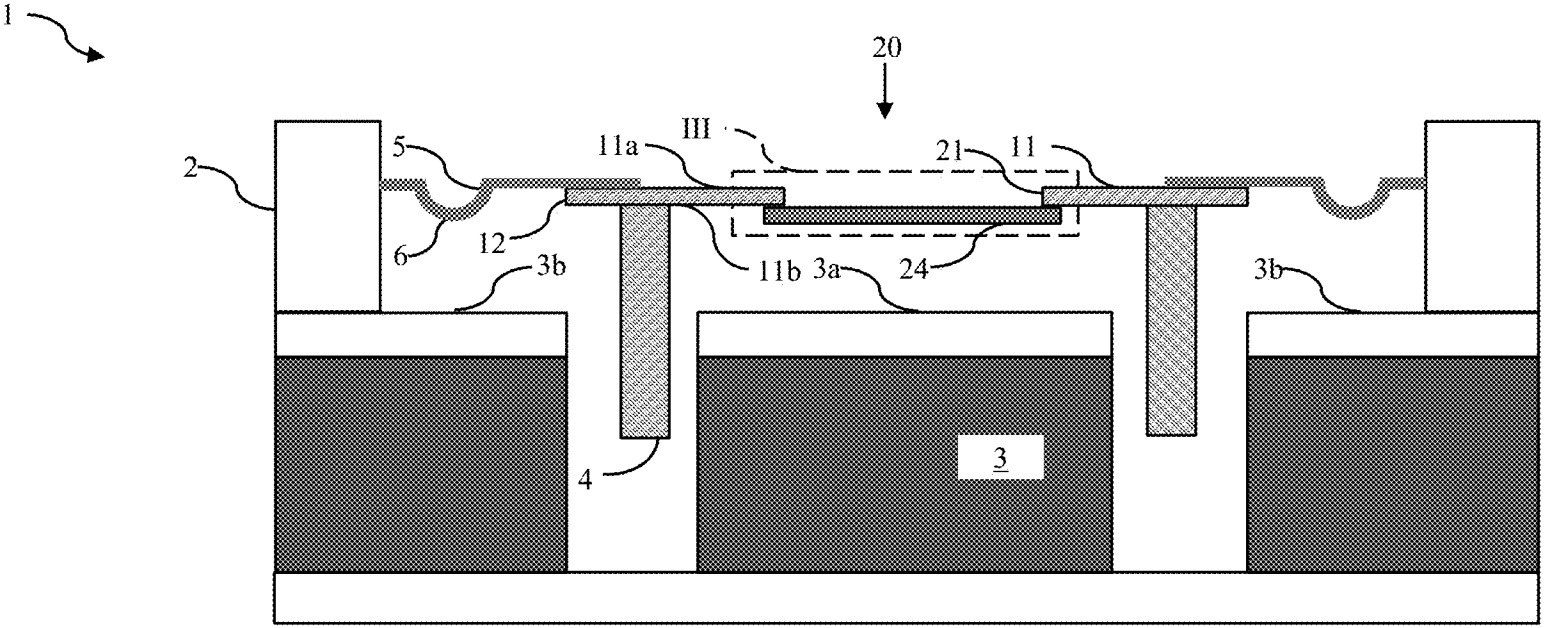
FIG. 1 illustrates a cross-sectional view of an acoustic module incorporating a barometrically vented acoustic transducer embodying selected principles disclosed herein.
Figure 2:
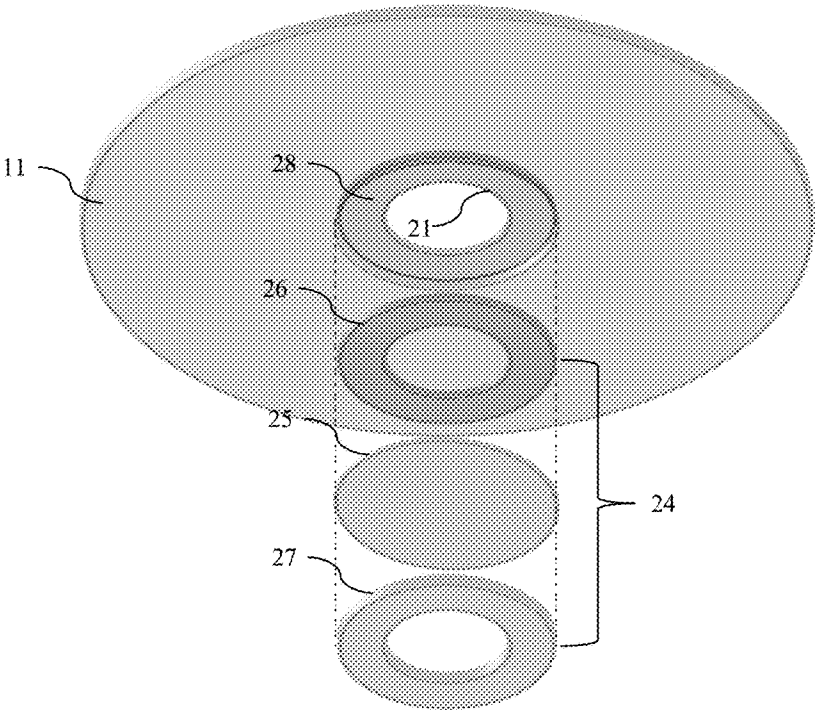
FIG. 2 illustrates an exploded view of the barometrically vented, acoustic diaphragm shown in FIG. 1.

Referring to FIGS. 1 and 2, an acoustic transducer 10 can have an acoustic diaphragm 11 incorporating a barometric vent 20. For example, the diaphragm 11 can have a first major surface 11*a* positioned opposite a second major surface 11*b*. A region of the diaphragm can be gas-permeable, and in some embodiments the region can be liquid-impermeable below a selected upper-threshold pressure gradient across the diaphragm.

For example, an aperture 21 can extend through the diaphragm 11 to define a passageway, or vent, extending from the first major surface 11*a* to the second major surface 11*b*. The vent can be sized to permit a given flow rate of an ambient fluid, e.g., air or another gas, or a liquid, to pass therethrough with a selected degree of pressure (or head) loss. Such a barometric vent can equalize a static pressure gradient across the diaphragm as between the first major surface 11*a* and the second major surface 11*b*, while still allowing the acoustic diaphragm to move, e.g, pistonically, or otherwise vibrate to emit or to receive an acoustic signal in a carrier medium. For example, a hydraulic diameter of the gas-permeable aperture can be smaller than a shortest-expected acoustic wave length corresponding to a range of operating frequencies for the acoustic transducer 10.

Nonetheless, inhibiting a liquid or a contaminant from passing through the vent 20 while allowing a flow of gas through the vent might be desired in some, e.g., water-resistant or dusty, applications. As shown in FIG. 1, a gas-permeable vent membrane 24 can be positioned to span across the vent aperture 21. Although FIG. 1 shows the vent membrane in registration with the second surface 11*b*, some transducer embodiments position the vent membrane 24 in registration with the first major surface 11*a*.

Depending on physical characteristics possessed by the vent membrane 24, the membrane 24 can inhibit contaminants and/or liquids from passing through the vent, while being gas permeable. For example, a mesh screen having a pore size smaller than suspended contaminant particles can prevent or inhibit such particles from entering or passing through the vent 20. A vent membrane 24 formed of PTFE or ePTFE, or an alternative thereto, can prevent or inhibit a liquid (and particulate contaminants) from passing through the aperture 21 while permitting a desired flow of gas therethrough. In some vent-membrane embodiments, a coating or a treatment can be applied to enhance oleophobicity of the membrane. Such a treatment can be rendered ineffective or less effective if exposed to a surfactant (e.g., soap) that lowers a surface energy of a liquid. Moreover, such a surfactant can also reduce breakthrough pressure that a given membrane can withstand.

Other vent-membrane embodiments can have a composite or a laminate construction. For example, plural layers of material can be laminated together. In one example, a woven or knit material can be laminated to ePTFE or PTFE to add tensile and/or shear strength to the membrane. In other embodiments, a composite vent membrane can be formed by forming ePTFE (or other material) around a lattice structure (e.g., a knit or woven sheet material, like a fabric or screen, formed of any of a variety of materials).

Figure 9:
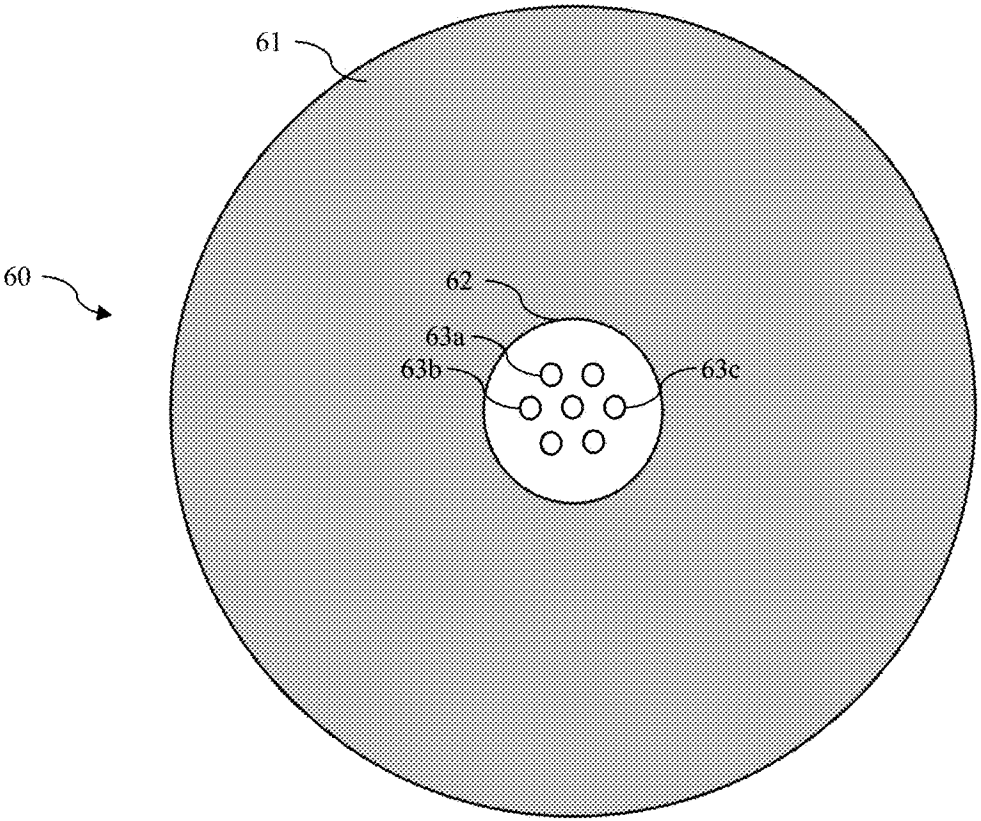
FIG. 9 schematically illustrates a plan view from above an alternative embodiment of a barometrically vented acoustic diaphragm, similar to the embodiment shown in FIGS. 2 and 4. The barometric vent shown in FIG. 9 has several apertures extending through the acoustic diaphragm.

An acoustic diaphragm having a gas-permeable and water-impermeable region need not have a perforation or other aperture covered by a laminated vent membrane adhered to the diaphragm. Rather, a support structure for the diaphragm, or even the diaphragm itself, can be perforated, as generally depicted in FIG. 9. A suitable process can be used to distribute, apply, deposit, adhere, or otherwise attach a porous, gas-permeable and liquid-impermeable membrane to the perforated area. For example, polymerized fibers can be deposited directly to the perforated support structure or the perforated diaphragm using an electrospinning process. As but one particular example, electrospinning can deposit PVDF fibers to a skeletal structure. Electrospinning and other deposition processes can eliminate the need for laminated, adhesive bonds as described above, while still providing a diaphragm with a gas-permeable and liquid-impermeable vented region.

Some acoustic transducers, as with the embodiment shown in FIG. 1, can include a further inhibitor to liquid penetration into or through the acoustic diaphragm 11. In the embodiment shown in FIG. 1, a layer 5 of silicone overlies a portion of the first major surface 11*a* of the diaphragm 11. The silicone layer 5 defines an aperture 5*a* having a size and a shape corresponding (albeit larger, smaller, or identical in size) to that of the aperture 21. The silicone can be applied as an overmold to the diaphragm, and a supply of silicone during the overmolding process can be limited or otherwise controlled to form the aperture 5*a* in the silicone, as explained more fully below in relation to FIG. 15. Alternatively (or additionally), the aperture through the silicone and/or the diaphragm 11 can be laser-cut. Although an overmolded layer 5 is depicted in FIG. 1, some embodiments of the further inhibitor to liquid penetration include an over-molded encapsulant (e.g., a layer applied to each of the first major surface 11*a* and to the second major surface 11*b*).

Figure 15:
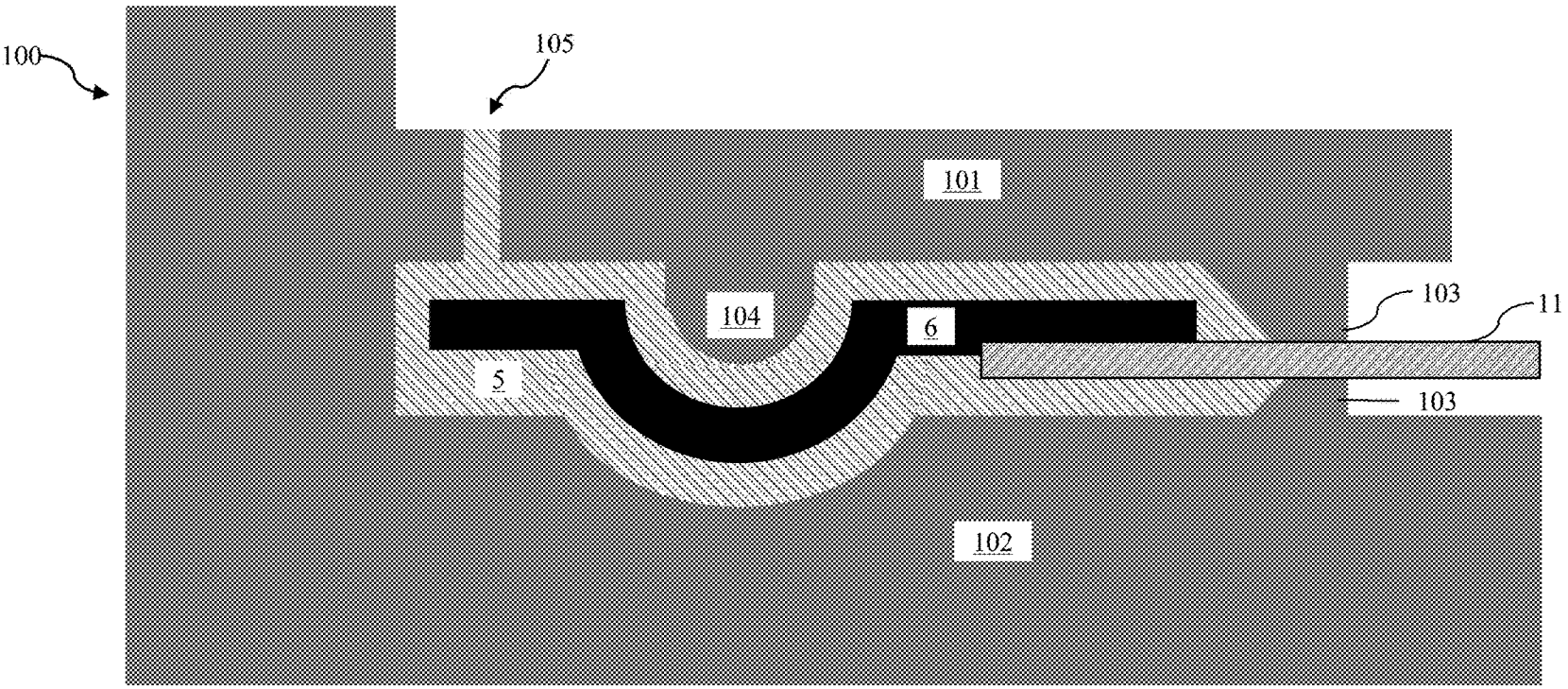
FIG. 15 schematically illustrates a diaphragm and suspension of the type described herein in a die set to over mold the suspension and a portion of the diaphragm with, for example, a silicone composition.

The illustrated transducer 10 shown in FIG. 1 forms a portion of a barometrically-vented acoustic-transducer module 1. The module 1 has a frame 2 and a suspension system 6 supportively coupling the acoustic diaphragm with the frame 2. The illustrated suspension system 6 includes a surround extending outward of the outer periphery 12 of the diaphragm 11. In the example in FIG. 1, the suspension system 6 constitutes an extension of the overmolded layer 5 of silicone. In other embodiments, for example as shown in FIG. 15, the over molded layer 5 can be formed over a selected portion of the surround 6.

A voice coil 4 is physically coupled with the second major surface 11*b* of the diaphragm 11. In FIG. 1, the diaphragm and the coil are movable in correspondence with each other. A magnet 3 can be so positioned adjacent the voice coil 4 as to cause a magnetic field of the magnet to interact with a magnetic flux corresponding to an electrical current through the voice coil 4.

In the particular embodiment shown in FIG. 1, the voice coil 4 is positioned between an inner magnet 3*a* and an outer magnet 3*b*. With the configuration in FIG. 1, the voice coil is configured to move pistonically to and fro between a distal-most position and a proximal-most position relative to the inner magnet 3*a*. Moreover, the inner magnet 3*a* and the arrangement of the vent membrane 24 and the acoustic diaphragm are complementarily configured relative to each other such that the inner magnet is configured to support the vent membrane/diaphragm assembly when urged together, as under a barometric pressure gradient across the acoustic diaphragm. In some other embodiments, the second major surface 11*b* of the acoustic diaphragm 11 and the inner magnet 3*a* are also complementarily contoured to provide similar support to the diaphragm 11 under a (e.g., hydrostatic) pressure gradient of sufficient magnitude to urge the diaphragm 11 against the inner magnet 3*a*.

Figure 3A:
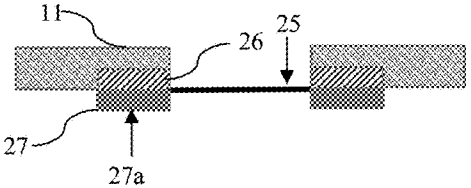
FIG. 3A illustrates an enlarged, cross-sectional view of the structure within the dashed box labeled III in FIG. 1, showing detail of the laminated assembly depicted in the exploded view of FIG. 2.

Referring now to FIG. 2, an arrangement of the exemplary gas-permeable region 24 of the diaphragm 21 in FIG. 1 is described. As in FIG. 1, the illustrated gas-permeable region 24 of the diaphragm has a vent membrane 25 spanning the aperture 21 in the diaphragm 11. A peripheral region of the membrane 25 is fixedly attached to a corresponding region 28 of the second major surface 11*b* with a pressure-sensitive adhesive 26. In the laminated construction shown in FIG. 2, a gasket 27 is positioned in correspondence with and opposite the pressure-sensitive adhesive relative to the vent membrane 25, though the gasket is optional. Moreover, as shown in the enlarged, cross-sectional view of FIG. 3, the illustrated gasket 27 has a selected depth suitable to position an underside 27*a* of the gasket below the second major surface 11*b* of the diaphragm. Such an arrangement defines a step or a shoulder relative to the second major surface of the diaphragm. Thus, as the vent membrane/diaphragm assembly approaches the inner magnet 3*a* in FIG. 1, as under a hydrostatic or other load, the underside 27*a* of the gasket 27, which forms a land, contacts a corresponding region of the inner magnet. An increase to the hydrostatic or other load can increase and further urge the vent membrane/diaphragm assembly toward the magnet, placing the gasket, and the corresponding regions of the vent membrane 25 and pressure-sensitive adhesive 26, in further compression between the gasket 27 and the region 28 of the diaphragm 11. Such a compressive load applied to the pressure sensitive adhesive layer 26 between the vent membrane 25 and the diaphragm region 28 can improve or enhance a degree of adhesion between the vent membrane and the diaphragm. Other classes of adhesive also are possible. For example, the adhesive can be a heat-activated film, a thermoplastic, or a thermoset material. In general, the adhesive can be any material or combination of materials suitable to maintain the vent membrane 26 in registration with the diaphragm 11.

The gasket 27 can be formed of any material suitable for applying such a compressive load to the vent membrane and pressure-sensitive adhesive layer. Nonetheless, such a gasket formed of a gas- and/or liquid-impermeable material can confer additional advantages, both during use and during manufacturing. For example, a liquid-impermeable gasket 27 can seal against the magnet under a sufficient hydrostatic load to prevent liquid, which might otherwise pass through the vent membrane 25, from entering a chamber behind the diaphragm (e.g., a chamber as in FIG. 1 bounded in part by the second major surface 11*b* of the diaphragm and in part by the inner magnet 3*a*). Such a hydrostatic load could arise when a loudspeaker containing such a barometric vent is submerged in water to a depth beyond that specified for the vent material.

Additionally, a gas-impermeable gasket 27 can permit hydrostatic and/or barometric testing of the diaphragm, as during manufacturing, without using water or some other liquid, which can be undesirable in relation to consumer and other electronics. For example, a rapid increase in barometric pressure applied to the vented diaphragm in FIG. 1 can sufficiently displace the diaphragm to urge the gasket 27 into a sealing engagement with the magnet 3. Once such a sealing engagement is attained, barometric pressure can be increased further, if desired, to assess a degree of gasimpermeability of the remainder of the diaphragm assembly, without regard to the venting provided by the gas-permeable vent region 24.

Rather than using a rapid increase in barometric pressure to urge the gasket into a sealing engagement with the magnet, a sufficient electrical current, e.g., a sufficient DC current, can be applied to the voice coil to urge the vented region of the diaphragm, e.g., the gasket land 27*a*, toward and into contact with the magnet 3. As above, once a sealing engagement between the gasket 27 and the magnet 3 is attained, barometric pressure can be increased, as desired.

Similarly, the diaphragm 11 can be selectively positioned relative to the magnet 3 under a variety of pressure gradients applied across the diaphragm 11. For example, a selected DC current can be applied to the voice coil to selectively adjust a "neutral" position of the diaphragm under a given pressure gradient across the diaphragm.

Figure 3B:
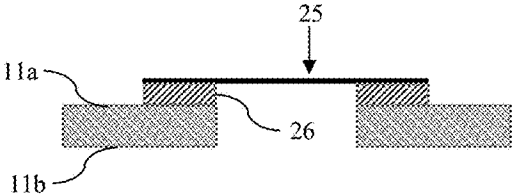
FIG. 3B illustrates detail of an alternative laminated assembly of an acoustic diaphragm having a barometric vent.
Figure 3C:
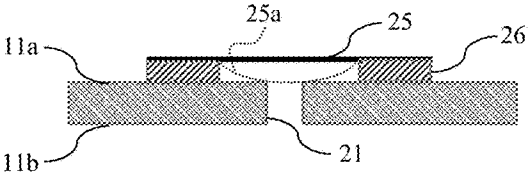
FIG. 3C illustrates another alternative laminated assembly of an acoustic diaphragm having a barometric vent.
Figure 4A:
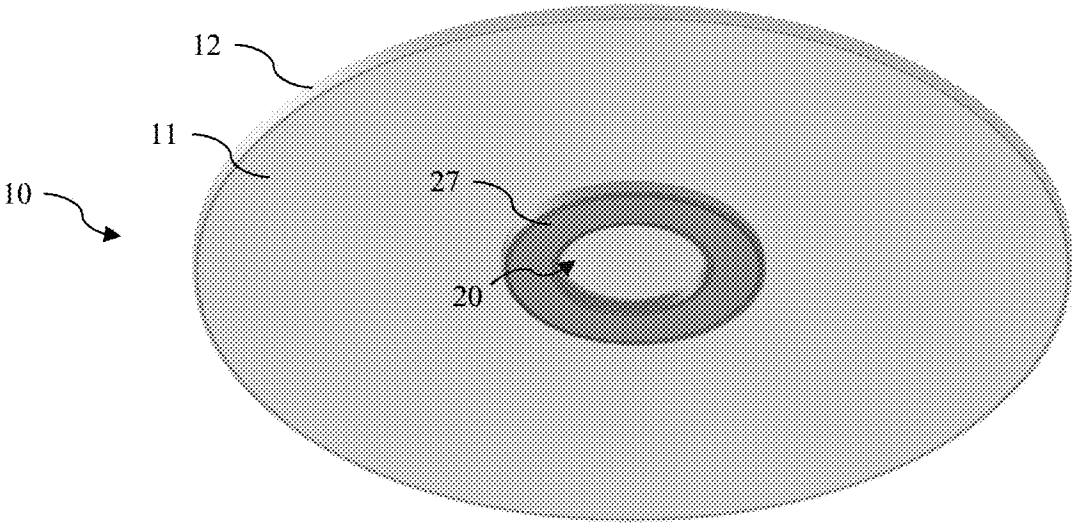
FIG. 4A schematically illustrates an isometric view from below an acoustic diaphragm having a barometric vent of the type depicted in FIGS. 2 and 3A.
Figure 4B:
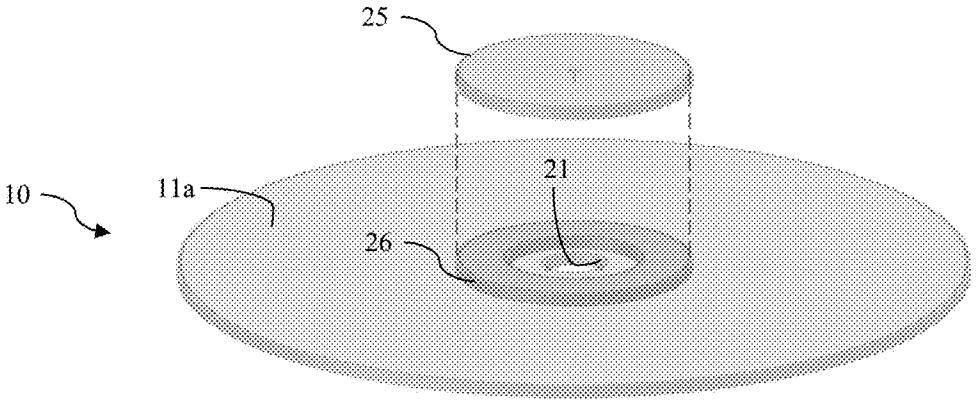
FIG. 4B schematically illustrates an exploded, isometric view from above an acoustic diaphragm having a barometric vent of the type depicted in FIG. 3C.
Figure 4C:
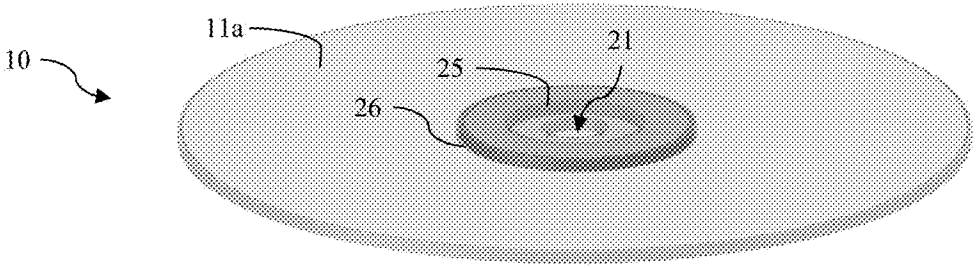
FIG. 4C schematically illustrates an isometric view from above the acoustic diaphragm shown in FIG. 4B FIG. 5 schematically illustrates an isometric view from above another embodiment of an acoustic diaphragm having a barometric vent.

As noted above, alternative constructions are possible. For example, the vent membrane 25 can be in registration with the first major surface 11*a* of the diaphragm as shown in FIGS. 3B and 3C, rather than in registration with the second major surface 11*b*. In FIGS. 3B and 3C, an annular layer of adhesive 26 affixes the membrane to the first major surface. In FIG. 4B, the adhesive layer 26 is affixed to the first major surface 11*a* and co-centrically aligned with the aperture 21. The membrane 25 is shown spaced from the adhesive to reveal the aperture 21. In FIG. 4C, the membrane 25 is affixed to the adhesive layer 26 and depicted in translucent form, again to reveal the aperture 21.

Aligning the aperture through the annular adhesive 26 with an aperture 21 through the diaphragm can be difficult. For example, an individual aperture 21 can have a relatively small diameter, as when the barometric vent through the diaphragm 11 is defined by a plurality of individual apertures 21. Such an embodiment is described more fully below in relation to FIG. 9. In some instances, the diameter of a single aperture measures about 0.3 mm, such as between about 0.2 mm and about 0.4 mm. Apertures 21 having such dimensions can inhibit resonance and provide higher-quality sound emission. In general, the diameter of a given aperture, and an arrangement of the barometric vent (e.g., whether defined by a single aperture 21 or a plurality of apertures as in FIG. 9), can be selected according to several figures of merit, including acoustic performance, airflow achievable across the diaphragm, and water resistance. With such small apertures, small deviations in position of the adhesive layer relative to a desired position as shown in FIG. 3B, the adhesive layer 26 can overlie some or all of the aperture 21, reducing the effectiveness of the barometric vent.

To provide improved dimensional tolerances with regard to position of the adhesive layer 26 relative to the aperture 21 through the diaphragm 11, the annular adhesive layer can define an aperture having a relatively larger cross-sectional dimension, e.g., diameter, as compared to a comparable cross-sectional measure of the aperture 21 through the diaphragm. Such an arrangement is shown in FIG. 3C. And, even if the vent membrane 25 deforms (depicted by the dotted line 25*a*), as when exposed to a static pressure externally of the vent 21, the diaphragm 11 can support the deformed membrane.

In addition to driving the diaphragm 11 with a DC current to adjust a pistonic offset of the diaphragm from its neutral position, as described above, a large-magnitude impulse can displace the diaphragm rapidly. With a membrane in registration with the first (e.g., exterior) major surface of the diaphragm 11, as described, the diaphragm (and the vent membrane) can displace water or other contaminants without urging the membrane away from the diaphragm. For example, the diaphragm and membrane assembly just described can be used as a positive-displacement pump, as to eject water from a chamber around the front side 11*a* of the diaphragm 11. As the assembly urges against the water or other contaminant, the membrane 25 will be compressed between the water or contaminant and the diaphragm 11, rather than urged away from the diaphragm as it would be if positioned in registration with the back side 11*b* of the diaphragm. Nonetheless, the diaphragm arrangement described in relation to FIGS. 2 and 3A also can be used as a pump, particularly when the tensile load applied to the adhesive layer 26 is less than a threshold load, e.g., a threshold of a peeling load.

Figure 5:
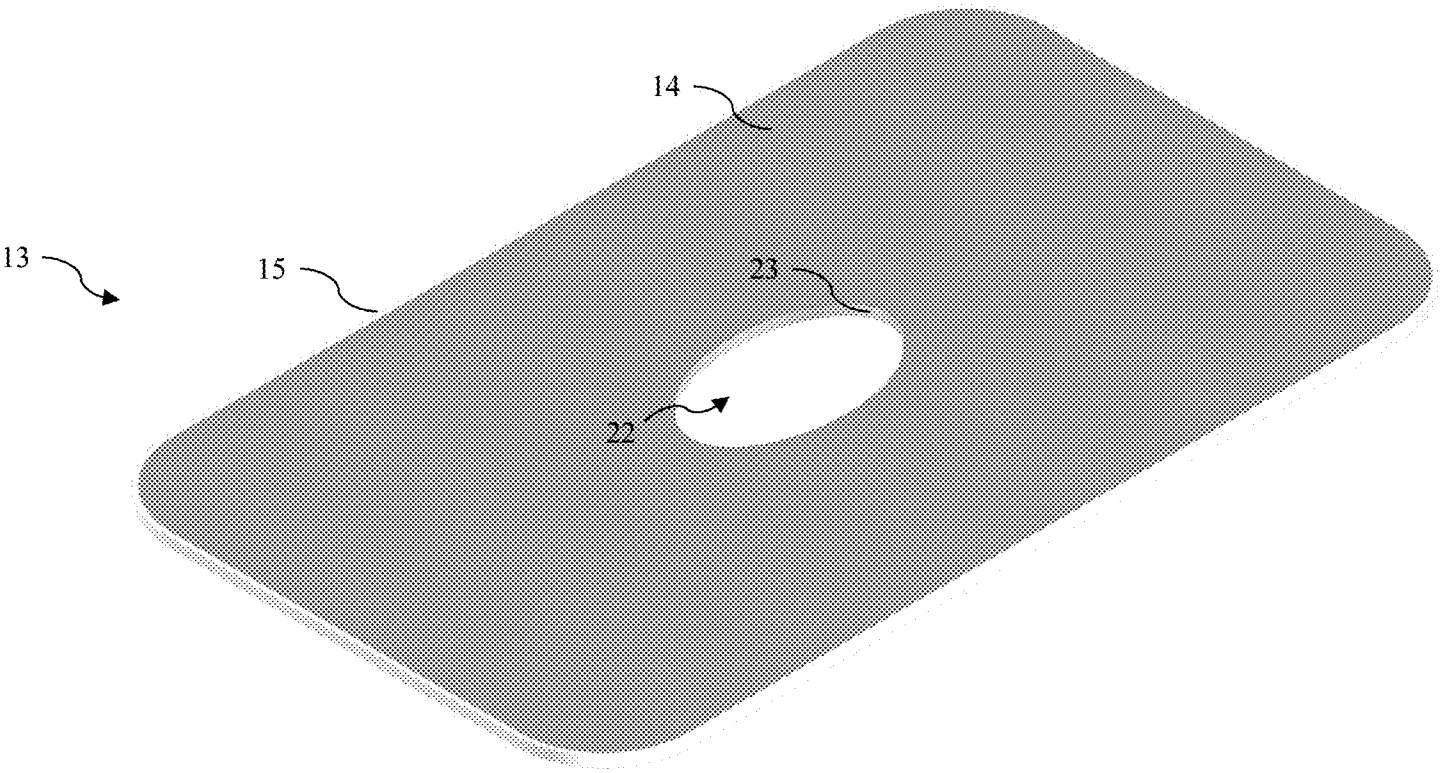

Referring now to FIG. 5, another acoustic transducer 13 is shown. As indicated, the acoustic diaphragm 14 need not be axi-symmetric. For example, some diaphragms 14 have a rectangular or a square periphery 15, and those of ordinary skill in the art will appreciate that still other shapes of acoustic diaphragm are possible. Similarly, an outer periphery 23 of a barometric vent 22 can have a similar or different shape as compared to an outer periphery 15 of the corresponding acoustic diaphragm 14. Stated differently, a barometric vent 22 need not be coaxial or concentric with a diaphragm. Accordingly, a barometric vent can be positioned off-center relative to the underlying diaphragm. That being said, in many instances the barometric vent 22 and the corresponding diaphragm 14 will be co-centrically aligned with each other so as to position a center-of-mass of the barometrically-vented diaphragm conveniently, e.g., coincident with an area centroid of the combined vent and diaphragm.

Figure 6:
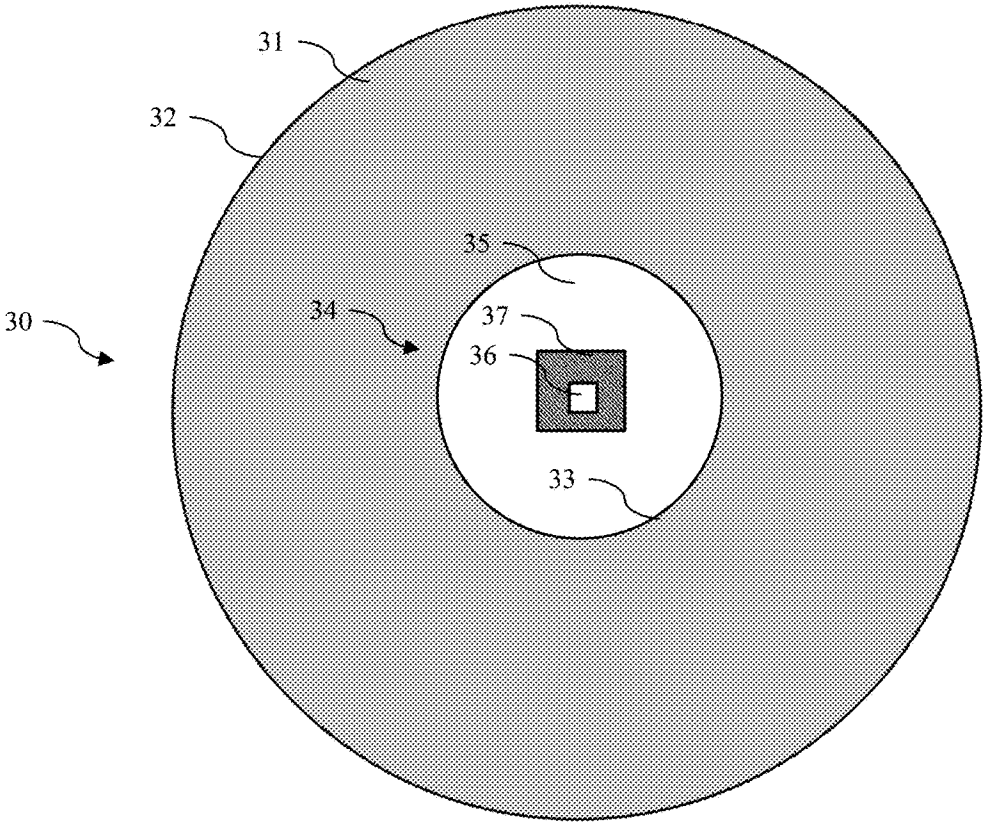
FIG. 6 schematically illustrates a plan view from above yet another embodiment of an acoustic diaphragm having a barometric vent and a circuit board suspended by a vent membrane.

Referring now to FIG. 6, an acoustic transducer 30 can have an acoustic diaphragm 31 with an outer periphery 32 and a barometric vent 34. As described above, the vent 34 can have an aperture with a corresponding outer periphery 33. A circuit board 37 can be positioned within the outer periphery of the periphery 33 and have an outer edge spaced apart from the outer periphery 33 to define a gap between the outer edge of the circuit board 37 and the outer periphery 33. A vent membrane 35 can span the gap between the outer edge of the circuit board and the outer periphery 33.

In other embodiments, a flexible circuit board, sometimes referred to as "flex circuit" or "flex" in the art, can span from the outer periphery 33 across the aperture. For example, the flex can sealingly mate with the diaphragm 31 outward of the periphery 33 of the aperture. The flex can be perforated or otherwise define one or more through-hole apertures sized to permit a desired flow of gas to pass therethrough. The flex, in turn, can be operatively coupled with one or more components. Such a component can include a sensor of various types, and/or other functional and/or computational attributes. A vent membrane of a type described herein can span across each of the one or more through-hole apertures defined by the flex. In another embodiment, the diaphragm 11 (FIG. 1) can be formed of flex and one or more components can be operatively coupled on, in, or to the flex.

The circuit board 37 (or flex) can include a sensor 36 and/or an integrated circuit. The sensor can be a displacement sensor configured to measure a displacement of the acoustic diaphragm 31. In another instance, the sensor 36 can be a pressure transducer configured to detect a change in barometric pressure above a selected lower-threshold change in barometric pressure. In yet another instance, the sensor 36 can be a wet pressure sensor configured to determine a hydrostatic pressure in a region of a fluid (e.g., a liquid) adjacent the vent membrane 35. A combined center-of-mass of the acoustic diaphragm 31, the vent membrane 35, and the circuit board 37, together with any components mounted thereto, including the sensor 36, can be substantially coincident with an axis-of-movement of the acoustic diaphragm 31.

Figure 7:
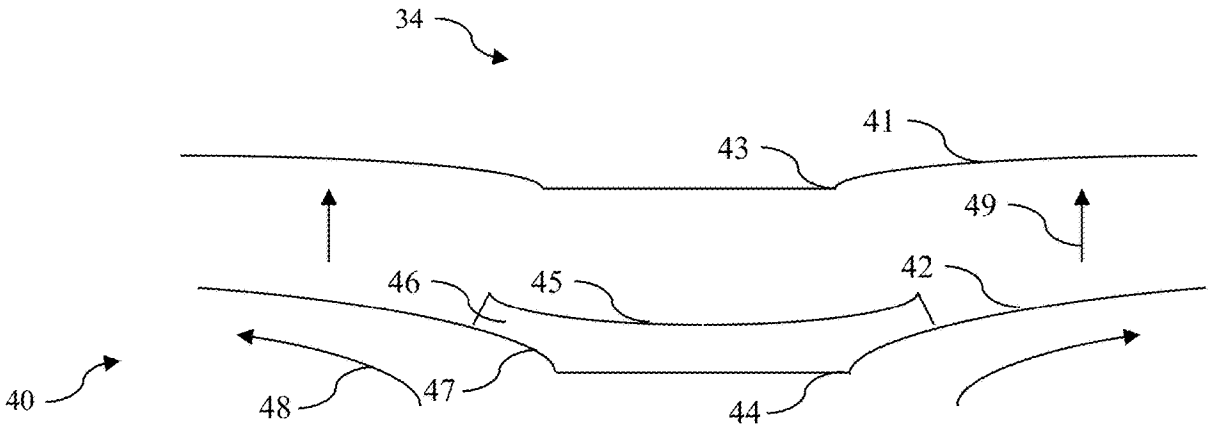
FIG. 7 schematically illustrates a side elevation and exploded view of a laminated, barometrically vented, acoustic diaphragm.
Figure 8:
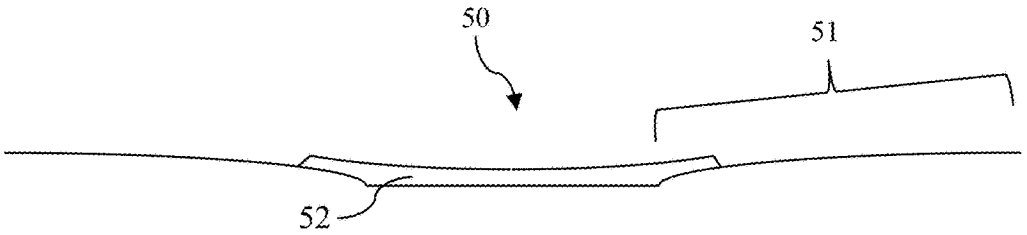
FIG. 8 schematically illustrates a side elevation view of the laminated acoustic diaphragm shown in FIG. 7 having a vent membrane positioned between layers of the diaphragm.

Several details pertaining to construction of an acoustic diaphragm having a barometric vent are described in relation to FIGS. 7 and 8. In FIG. 7, an acoustic diaphragm 41 (or layer thereof, as described below) has an aperture 43 defining a portion of a barometric vent, similar to the arrangements discussed above.

A second layer of the acoustic diaphragm 42 also has an aperture 44. A vent membrane 45 spans the aperture 44 and an outer region 46 of the membrane overlies a corresponding region 47 of the diaphragm positioned outward of the aperture. In FIG. 7, the membrane 45 overlies a portion of an upper, or first, major surface of the diaphragm layer 42. In such an arrangement, a positive hydrostatic pressure applied to the vent membrane 45 and the first major surface will tend to urge the membrane further against the diaphragm, e.g., in compression.

Nonetheless, the membrane 45 can be applied to the opposed lower, or second, major surface of the diaphragm 42, as shown in FIGS. 1 and 1A. In such an arrangement, a positive hydrostatic pressure applied to the vent membrane 45 and the first major surface can tend to urge the membrane away from the diaphragm, tending to urge the vent membrane to delaminate or peel from the diaphragm. If a region of the diaphragm outward of the aperture extends transversely out-of-plane of the aperture at an appropriate angle, the load applied to at the interface between the membrane and the diaphragm can be primarily in shear (e.g., in-plane relative to the interface between the membrane and the diaphragm). Such a shear load can inhibit peeling-like delamination. And, under a sufficient hydrostatic pressure, the vent membrane 45 and/or the acoustic diaphragm layer 42 can be displaced by such an extent as to urge against an underlying surface, for example, a surface of the inner magnet 3A shown in FIG. 1. Such support by an underlying surface can reduce a likelihood of, or altogether prevent, delamination of the vent membrane 45 from the acoustic diaphragm 42.

Referring still to FIGS. 7 and 8, the diaphragm 42 can constitute a first layer of a laminated acoustic diaphragm 50 (as in FIG. 8). A second layer (e.g., diaphragm 41) can have an aperture 43 having a size, shape, and position corresponding with the respective size, shape, and position of the aperture 44 in the first layer 42. The second layer 41 can overlie the first layer 42 and the vent membrane 45, positioning a segment 46 of the outer periphery of the vent membrane between the opposed first and second layers 41, 42. FIG. 8 illustrates such a laminated construct. The aligned apertures 43, 44, together with the vent membrane 45, can define a barometric vent 50. The vent membrane can form a gas-permeable and liquid-impermeable region 52. The outer region 51 of the diaphragm shown in FIG. 8 can provide an active surface for emitting or receiving acoustic signals.

Some disclosed acoustic diaphragms can include one or more features arranged to place the vent membrane in tension. For example, a given acoustic diaphragm can have one or more vent-membrane anchors (not shown) positioned outward of each aperture 43, 44 forming an opening of the barometric vent. The vent membrane can be affixed or otherwise mounted to the vent-membrane anchors, and the vent membrane anchors and/or a portion of the acoustic diaphragm can be configured to urge outwardly of the aperture, tensioning the vent membrane.

As depicted in FIG. 7, the first layer 42 and the second layer 41 can have complementary, but not necessarily identical, contours configured to matingly engage with each other and/or with the vent membrane 45. Such complementary contours can be attained by thermoforming the transducer diaphragms. For example, the first layer 42 can have a relatively more concave contour (relative to an upper major surface placed in contact with an opposed, lower major-surface of the second layer 41). With such an arrangement, an outer region (e.g., region 51 in FIG. 8) of the diaphragm can be urged outward, as indicated by the arrow 48, when brought to bear against the second layer 41, as indicated by the arrow 49. Such an outward urging can place the vent 45 in tension, as the layer 42 flattens relative to its un-deformed configuration as shown in FIG. 7.

Although barometric vents having a single aperture are described above, some barometric vents in an acoustic diaphragm have a plurality of apertures. In FIG. 9, for example, the acoustic transducer 60 has an acoustic diaphragm 61 and a region 62 defining a barometric vent. However, in FIG. 9, the barometric vent has a plurality of apertures 63*a*, 63*b*, 63*c*. A vent membrane spans across each of the apertures. In some embodiments, a single vent membrane spans across all of the apertures. In other embodiments, a respective vent membrane spans across a corresponding one of the apertures. In still other embodiments, a respective vent membrane spans across more than one corresponding aperture.

Figure 10:
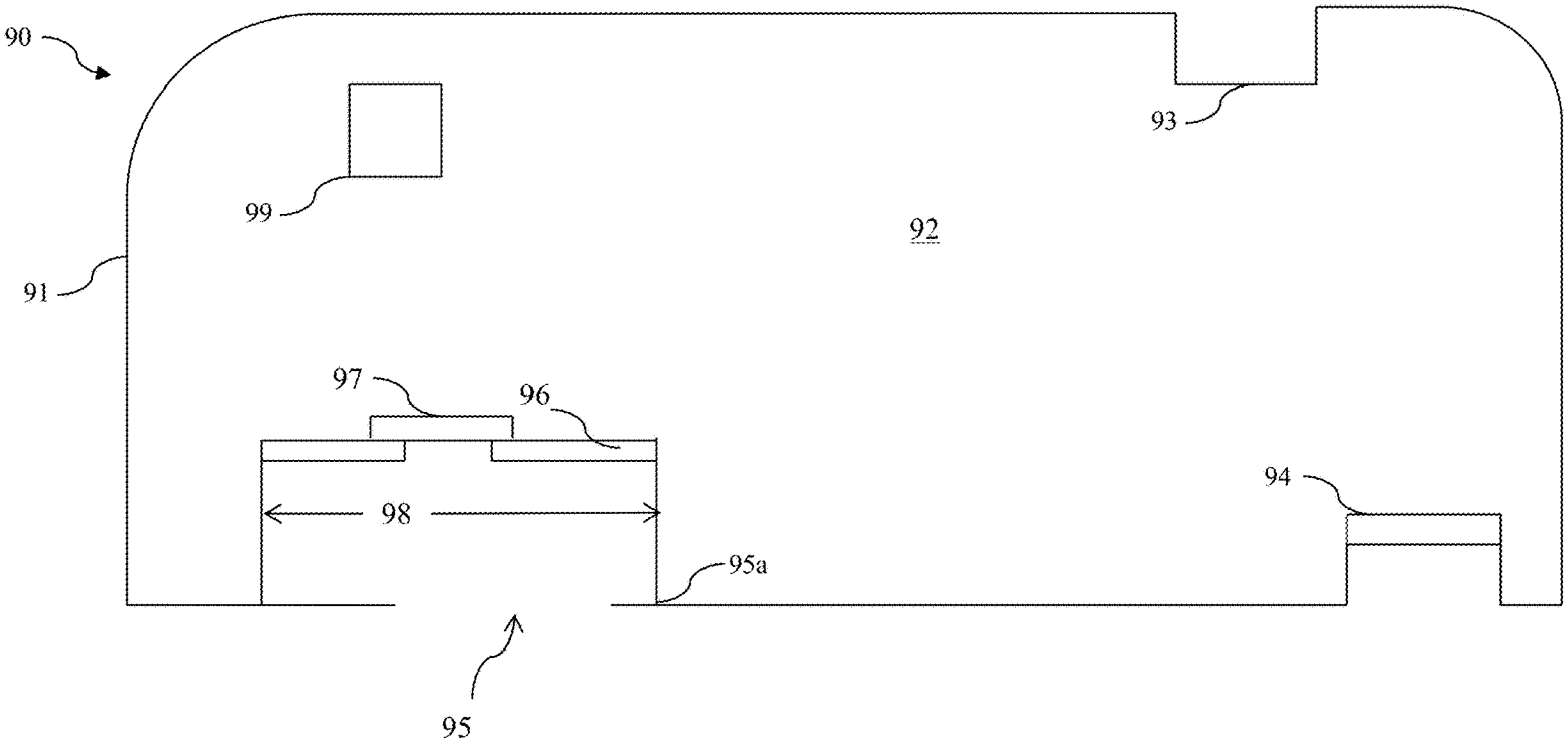
FIG. 10 schematically illustrates a cross-sectional view of a liquid-resistant housing incorporating a barometrically vented acoustic-transducer module similar to the module depicted in FIG. 1, together with several other functional modules.
Figure 11:
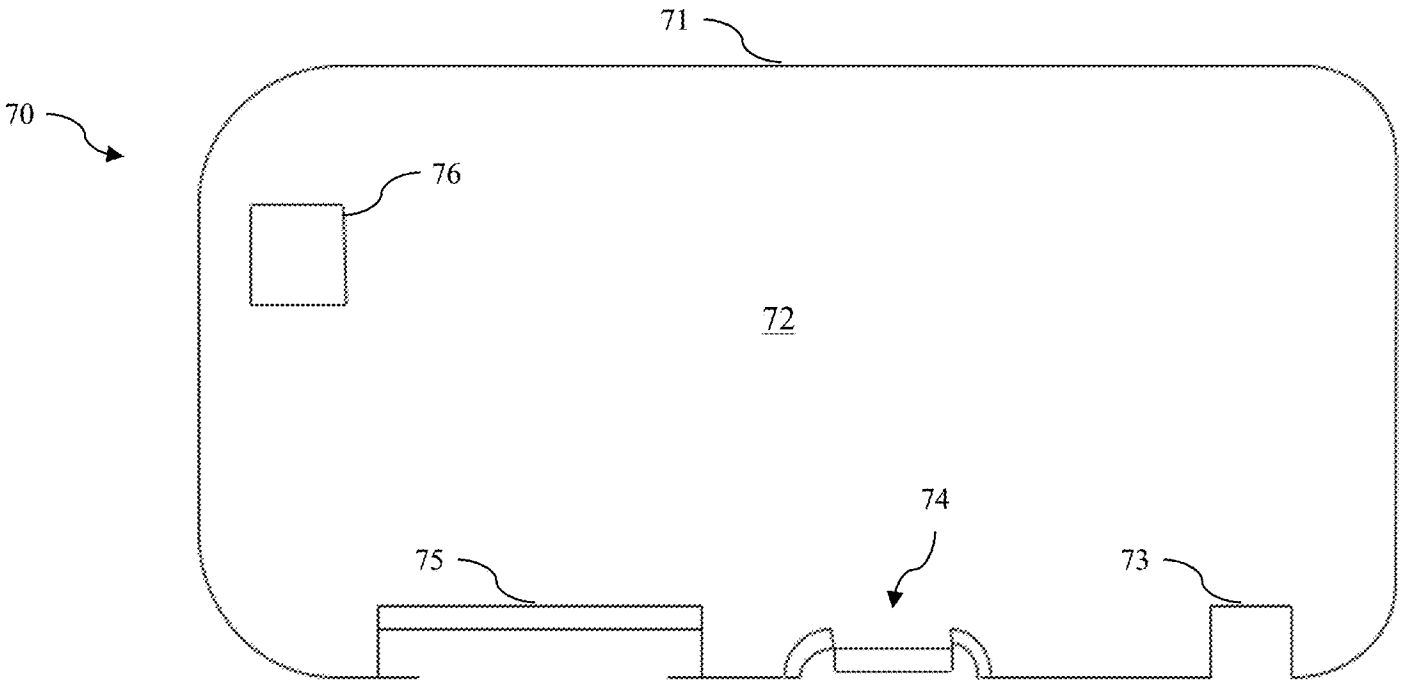
FIG. 11 schematically illustrates a cross-sectional view of a previously proposed liquid-resistant housing incorporating an acoustic-transducer module and a separate barometric vent. The embodiment in FIG. 8 lacks one or more features compared to the embodiment depicted in FIG. 7.
Figure 12:
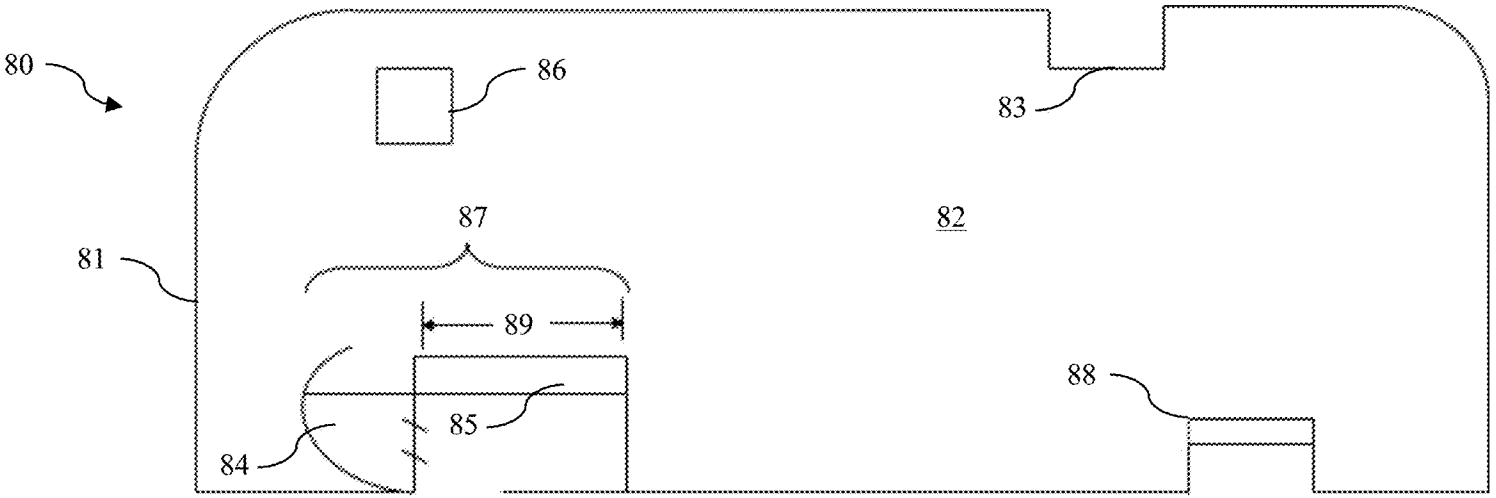
FIG. 12 schematically illustrates a cross-sectional view of a previously proposed liquid-resistant housing incorporating a barometrically vented acoustic-transducer module similar to the module depicted in FIGS. 13 and 14.
Figure 13:
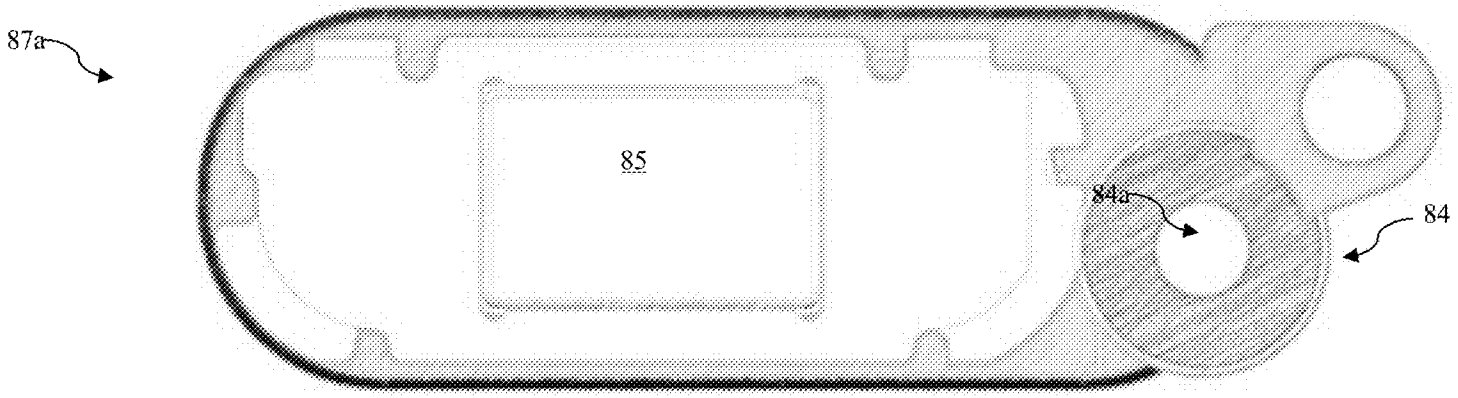
FIG. 13 depicts a plan view from above a barometrically vented acoustic-transducer module. The module has a barometric vent separate from and adjacent the module's acoustic diaphragm.
Figure 14:
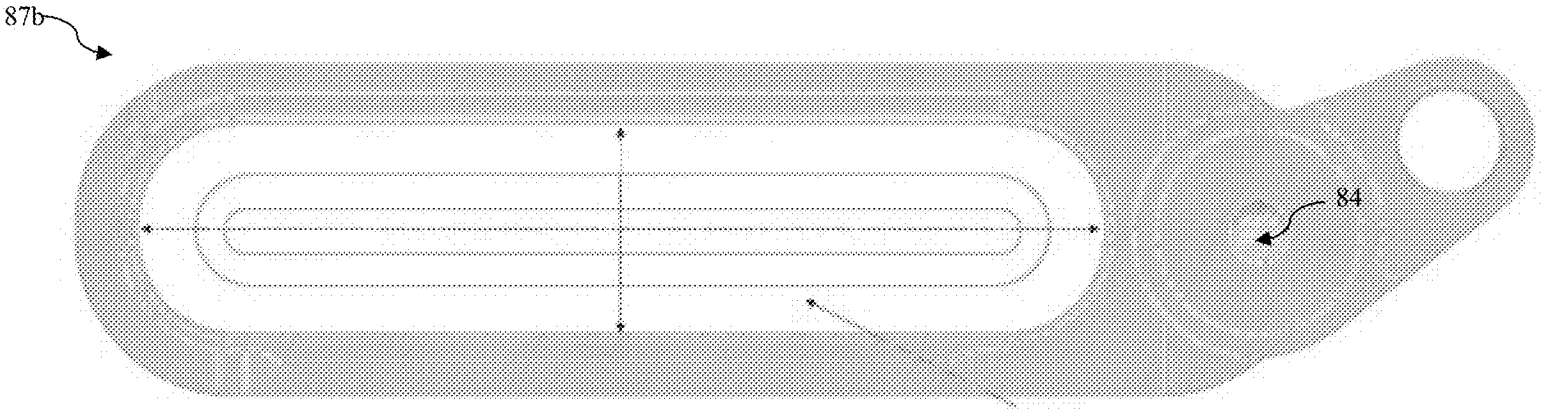
FIG. 14 depicts a plan view from below the module shown in FIG. 13.

Referring now to FIG. 10, a schematically illustrated, water-resistant electronic device 90 has a housing 91 defining an interior chamber 92. A microphone transducer 93 is exposed to an exterior of the housing. A so-called "wet" pressure sensor 94 also is exposed to an exterior of the housing 91. Such a wet sensor can detect a magnitude of a hydrostatic pressure, as when the device 90 is submerged in, for example, water. The wet pressure sensor can detect a barometric pressure, as well. The device 90 also includes a module 95 having an acoustic diaphragm 96 and a corresponding barometric vent 97 with a vent membrane, as described above. The module 95 also has a chassis 98 mounted to the housing 91. The chassis 98 supports the vented acoustic diaphragm 96 in the illustrated embodiment.

The module 95 is sealably coupled with the housing 91 at an interface region 95*a* corresponding to a passage defined by the housing 91 so as to inhibit a flow of gas or liquid across the interface region. Such a sealing engagement prevents a liquid or a gas from seeping into or out of the interior chamber 92 through a passage other than through the barometric vent membrane 97.

In FIG. 10, the barometric vent 97 is configured to permit a pressure-equalization flow of gas, and to inhibit a flow of liquid, into or out of the interior chamber 92 across the acoustic diaphragm 96. In some embodiments, the electronic device 90 has an electronic component 99 positioned in the housing 91. The electronic component 99 can, but need not, be operatively coupled with the acoustic diaphragm 96. With such a configuration, the electronic component 99 can be safely incorporated in the device 90, even if the component 99 is susceptible to being damaged if exposed to water or another liquid.

Referring now to FIGS. 11 through 14, advantages of presently disclosed acoustic transducers over previously proposed acoustic transducers and modules incorporating those transducers will become apparent in light of the following remarks. As space becomes more and more constrained in electronic devices, there is less room to have a speaker 75, 85 or other acoustic transducer of sufficient size while also having a barometric vent 74, 84 and/or another sensor (e.g., an altitude or a pressure sensor) or transducer (e.g., a microphone 73, 83). For example, a module 87 having a barometric vent 84 positioned adjacent an acoustic diaphragm 85 can limit, or reduce, the available size of the diaphragm, as compared, for example, to a diaphragm 96 incorporating a barometric vent 97 as depicted in FIG. 10. As a consequence, a transducer 75, 85 can have reduced performance and fail to meet desired acoustic performance targets compared to a vented transducer 95. It should be noted that the schematic depictions in FIGS. 10 through 14 omit for the sake of simplicity and clarity certain components and modules, including a processor, battery and other components customarily included in a water-resistant electronic device.

In general, however, a need remains to vent from the outside to the inside of the device. However, it is difficult to have a barometric vent that takes up limited space, survives required water entry pressure, and allows enough air flow in all conditions for the pressure sensor to measure accurately and timely (pressure adjustments may not be fast enough and could introduce error in the measurements). Also, prior vents can become blocked with water or other contaminants and not allow the device to equalize or to allow the pressure sensor to read accurately.

A pressure sensor, sometimes referred to in the art as a "wet" pressure sensor can be ported directly to the housing. Many such sensors can survive in excess of a 10 bar water pressure, and yet can provide extremely accurate pressure resolutions. Such sensors are readily available commercially from a variety of vendors.

As noted above, venting an acoustic diaphragm, transducer or module as described herein can allow a relatively larger transducer compared to implementations having separate diaphragms and barometric vents. A laterally larger transducer can be beneficial, as when a product's height, or thickness, reduces. In such an instance, the transducer can be made to be longer in one or more coordinate directions in an attempt to maintain good, or at least satisfactory, acoustic performance as compared to prior proposals of discrete vents and transducers. Beyond reclaiming space conventionally occupied by a barometric vent in favor of a vented transducer, such a transducer can actively clear water from the transducer, which in turn can remove water from the barometric vent and allow the system to "breathe". Additionally, disclosed barometric vents can also be better protected from clogging or damage as compared to prior proposals in which the barometric vent is directly ported through a wall of the housing 91.

An intermediate stage 100 of forming an over mold 5 relative to the suspension 6 and the diaphragm 11 (FIG. 1) is shown in FIG. 15. An opposed die set 101, 102 of a compression mold supports the diaphragm 11 and suspension 6 assembly. The die set 101, 102 also defines an open volume surrounding the suspension 6. An injection port 105 is fluidicly coupled with the open volume and permits an over mold material, e.g., a silicone compound, to be injected into the open volume (shown in cross-hatching) to surround the suspension 6 and diaphragm 11.

Jaws 103 extend from the die set 101, 102 in opposed relation to each other with the diaphragm 11 positioned therebetween. The jaws prevent the over-mold material from flowing beyond a desired boundary. For example, a position of the jaws 103 can correspond to an outer-most extent of a layer of adhesive 26 and/or an outer-most extent of a vent membrane 25 to prevent the over mold material from obstructing the barometric vent through the diaphragm 11.

The examples described above generally concern vented acoustic transducers and related methods and systems, and more particularly but not exclusively to such transducers incorporating a vented acoustic diaphragm.

Nonetheless, embodiments other than those described above in detail are contemplated based on the principles disclosed herein, together with any attendant changes in configurations of the respective apparatus described herein. For example, the principles described above in connection with any particular example can be combined with the principles described in connection with another example described herein.

Moreover, those of ordinary skill in the art will appreciate that the exemplary embodiments disclosed herein can be adapted to various configurations and/or uses without departing from the disclosed principles. Applying the principles disclosed herein, those of ordinary skill in the art will also appreciate that it is possible to provide a wide variety of barometrically vented acoustic transducers and related systems. For example, although electrodynamic transducers having a magnet and voice coil are described in some detail above for illustrative purposes, presently disclosed principles related to barometrically venting an acoustic diaphragm can be applied to a variety of transducer types and configurations. Several particular, but non-exclusive, examples of such transducers include flat-panel transducers (driven by an electrodynamic actuator, as above, or by way of an electrostatic actuator), multi-cell diaphragm transducers, and piezoelectric transducers. Further, those of ordinary skill in the art will appreciate that aspects of each particular embodiment described or shown in the accompanying drawings can be omitted altogether or implemented as a portion of a different embodiment without departing from related disclosed principles.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

Accordingly, this detailed description shall not be construed in a limiting sense, and following a review of this disclosure, those of ordinary skill in the art will appreciate the wide variety of acoustic transducers, and related methods and systems that can be devised using the various concepts described herein.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". All structural and functional equivalents to the features and method acts of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim recitation is to be construed under the provisions of 35 USC 112(f) unless the recitation expressly recites the phrase "means for" or "step for".

Thus, in view of the many possible embodiments to which the disclosed principles can be applied, we reserve to the right to claim any and all combinations of features and technologies described herein as understood by a person of ordinary skill in the art, including, for example, all that comes within the scope and spirit of the following claims.

We currently claim:

1. An acoustic transducer, comprising:

an acoustic diaphragm having opposed first and second major surfaces and defining a barometric vent configured to equalize a barometric pressure gradient as between the first and second major surfaces wherein the barometric vent comprises an aperture defined by the acoustic diaphragm, and wherein the aperture has a periphery; and a gas-permeable vent membrane sealably coupled with the acoustic diaphragm around the periphery of the aperture and extending across the barometric vent.

2. The acoustic transducer according to claim 1, wherein the vent membrane inhibits movement of liquid across the membrane.

3. The acoustic transducer according to claim 2, wherein the vent membrane prevents movement of water across the vent membrane for hydrostatic pressure gradients across the vent membrane below a selected threshold hydrostatic pressure gradient across the vent membrane.

4. The acoustic transducer according to claim 3, wherein the vent membrane comprises a membrane formed of one or more of PTFE and ePTFE.

5. The acoustic transducer according to claim 1, further comprising a liquid-impermeable encapsulant extending at least partially across one or both of the first and the second major surfaces of the acoustic diaphragm.

6. The acoustic transducer according to claim 5, wherein the encapsulant comprises an overmolded silicone applied to the respective one or both of the first and the second major surfaces of the acoustic diaphragm.

7. The acoustic transducer according to claim 5, wherein the encapsulant defines one or more apertures positioned in correspondence to the gas-permeable vent membrane.

8. The acoustic transducer according to claim 1, wherein a segment of an outer periphery of the vent membrane and a corresponding portion of the acoustic diaphragm form a laminated construction.

9. The acoustic transducer according to claim 8, wherein the acoustic diaphragm comprises a laminated construct having a first layer defining the first major surface and having a second layer defining the second major surface, wherein the segment of the outer periphery of the vent membrane is positioned between the first layer and the second layer of the acoustic diaphragm.

10. The acoustic transducer according to claim 1, further comprising a voice coil coupled with the acoustic diaphragm, such that the diaphragm and the coil are movable in correspondence with each other.

11. The acoustic transducer according to claim 10, further comprising a magnet so positioned adjacent the voice coil as to cause a magnetic field of the magnet to interact with a magnetic flux corresponding to an electrical current through the voice coil.

12. The acoustic transducer according to claim 11, wherein the magnet comprises an inner magnet and an outer magnet, wherein the voice coil is positioned between the inner magnet and the outer magnet and configured to move pistonically to and fro between a distal-most position and a proximal-most position relative to the inner magnet.

13. The acoustic transducer according to claim 1, wherein the acoustic transducer further comprises a circuit board positioned within the periphery of the aperture and having an outer edge to define a gap between the outer edge of the circuit board and the periphery of the aperture, wherein the vent membrane spans the gap between the outer edge of the circuit board and the periphery of the aperture.

14. The acoustic transducer according to claim 13, wherein the circuit board comprises a displacement sensor configured to measure a displacement of the acoustic diaphragm and/or a pressure transducer configured to detect a change in barometric pressure above a selected lower-threshold change in barometric pressure.

15. The acoustic transducer according to claim 13, wherein a combined center-of-mass of the acoustic diaphragm, the vent membrane, and the circuit board is substantially coincident with an axis-of-movement of the acoustic diaphragm.

16. The acoustic transducer according to claim 1, wherein the aperture comprises a first aperture, wherein the acoustic diaphragm further defines at least a second aperture spaced apart from the first aperture, and wherein the vent membrane defines a unitary construct spanning across the first aperture and the second aperture.

17. The acoustic transducer according to claim 16, wherein the acoustic diaphragm comprises a laminated construct having a first layer defining the first major surface and having a second layer defining the second major surface, wherein the unitary construct spanning across the first aperture and the second aperture is positioned between the first layer of the acoustic diaphragm and the second layer of the acoustic diaphragm.

18. The acoustic transducer according to claim 1, wherein the acoustic diaphragm comprises a laminated construct having a first layer defining the first major surface and having a second layer defining the second major surface, wherein the first layer of the acoustic diaphragm and the second layer of the acoustic diaphragm define complementarily shaped contours configured to matingly engage with the vent membrane and thereby to place the vent membrane into tension.

19. The acoustic transducer according to claim 1, wherein the gas-permeable vent membrane comprises a lattice structure covered in a porous material.

20. An acoustic transducer, comprising:

an acoustic diaphragm having opposed first and second major surfaces and defining a barometric vent configured to equalize a barometric pressure gradient as between the first and second major surfaces; and a voice coil coupled with the acoustic diaphragm, such that the diaphragm and the coil are movable in correspondence with each other; and a magnet so positioned adjacent the voice coil as to cause a magnetic field of the magnet to interact with a magnetic flux corresponding to an electrical current through the voice coil, wherein the magnet comprises an inner magnet and an outer magnet, wherein the voice coil is positioned between the inner magnet and the outer magnet and configured to move pistonically to and fro between a distal-most position and a proximal-most position relative to the inner magnet, wherein the barometric vent comprises an aperture defined by the acoustic diaphragm, wherein the acoustic transducer further comprises a gas-permeable vent membrane coupled with the acoustic diaphragm and extending across the aperture, wherein the inner magnet and the vent membrane and/or the second major face of the acoustic diaphragm are complementarily configured relative to each other such that the inner magnet is configured to support the respective vent membrane and/or the second major face of the acoustic diaphragm under a barometric pressure gradient across the acoustic diaphragm sufficient to urge the vent membrane and/or the second major face of the acoustic diaphragm into contact with the inner magnet.

21. The acoustic transducer according to claim 20, wherein the gas-permeable vent membrane comprises a lattice structure covered in a porous material.

22. An acoustic-transducer module, comprising:

an acoustic transducer having an acoustic diaphragm defining a barometric vent configured to equalize a barometric pressure gradient across the acoustic diaphragm, wherein the acoustic diaphragm comprises a gas-permeable vent membrane spanning across the barometric vent, wherein the gas-permeable vent membrane inhibits penetration of liquid through the barometric vent;

a chassis configured to mount the acoustic-transducer module to another module; and a suspension system movably coupling the acoustic diaphragm with the chassis.

23. The acoustic-transducer module according to claim 22, wherein the barometric vent comprises a gas-permeable region of the acoustic diaphragm.

24. The acoustic-transducer module according to claim 22, wherein the gas-permeable vent membrane comprises a lattice structure covered in a porous material.

25. The acoustic-transducer module according to claim 22, wherein the acoustic diaphragm defines a perforated region and comprises a porous material deposited to the perforated region and defining the gas-permeable vent membrane.

26. A water-resistant electronic device comprising a housing defining an interior chamber and having an exterior, wherein a passage extends through the housing from the exterior of the housing to the interior chamber;

an acoustic-transducer module sealably coupled with the housing at an interface region corresponding to the passage so as to inhibit a flow of gas or liquid across the interface region, wherein the acoustic-transducer module has an acoustic diaphragm having a gas-permeable, hydrophobic vent region to form a water-resistant barometric vent within the acoustic diaphragm, wherein the vent region comprises a gas-permeable vent membrane in registration with a major surface of the diaphragm.

27. The water-resistant electronic device according to claim 26, wherein the barometric vent is configured to permit a pressure-equalization flow of gas, and to inhibit a flow of liquid, into or out of the interior chamber across the acoustic diaphragm.

28. The water-resistant electronic device according to claim 26, wherein the acoustic-transducer module further comprises a chassis sealably mountable to the housing and a suspension system configured to supportively couple the acoustic diaphragm with the chassis.

29. The water-resistant electronic device according to claim 26, further comprising an electronic component positioned in the housing and operatively coupled with the acoustic diaphragm.

30. The water-resistant electronic device according to claim 29, wherein the electronic component is susceptible to being damaged if exposed to water.

31. The water-resistant electronic device according to claim 26, wherein the gas-permeable vent membrane comprises a lattice structure covered in a porous material.

* * * * *